US008052277B2

(12) United States Patent
Kim et al.

(10) Patent No.: US 8,052,277 B2
(45) Date of Patent: Nov. 8, 2011

(54) INKJET IMAGE FORMING APPARATUS HAVING ARRAY TYPE PRINT HEAD

(75) Inventors: Young Choon Kim, Seoul (KR); Heon Soo Park, Seongnam-si (KR); Chang Shin Park, Seongnam-si (KR); Karp Sik Youn, Hwaseong-si (KR); Myung Song Jung, Gunpo-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 199 days.

(21) Appl. No.: 12/473,372

(22) Filed: May 28, 2009

(65) Prior Publication Data

US 2010/0066793 A1 Mar. 18, 2010

(30) Foreign Application Priority Data

Sep. 12, 2008 (KR) ..... 10-2008-90358

(51) Int. Cl.
*B41J 2/01* (2006.01)

(52) U.S. Cl. ..... 347/104; 347/105; 347/12; 347/13

(58) Field of Classification Search ..... 347/104–105, 347/12–13
See application file for complete search history.

(56) References Cited

U.S. PATENT DOCUMENTS

| | | | | |
|---|---|---|---|---|
| 5,534,902 | A * | 7/1996 | Hoesly | 347/104 |
| 6,019,466 | A * | 2/2000 | Hermanson | 347/104 |
| 6,189,991 | B1 * | 2/2001 | Wen et al. | 347/13 |
| 7,255,427 | B2 * | 8/2007 | Mataki | 347/67 |
| 2006/0139395 | A1 * | 6/2006 | Nakashima et al. | 347/22 |
| 2007/0024668 | A1 * | 2/2007 | Folkins | 347/43 |
| 2007/0109387 | A1 * | 5/2007 | Tanabe | 347/104 |
| 2008/0043084 | A1 * | 2/2008 | Nakashima | 347/104 |

FOREIGN PATENT DOCUMENTS

JP 11-320937 11/1999

* cited by examiner

*Primary Examiner* — Ryan Lepisto
*Assistant Examiner* — Guy Anderson
(74) *Attorney, Agent, or Firm* — Stanzione & Kim, LLP

(57) ABSTRACT

An inkjet image forming apparatus having an array type print head to stably deliver a printing medium through a printing zone. The inkjet image forming apparatus includes an array type print head including a nozzle part to discharge ink to a printing zone, a first rolling unit having a first nip portion to nip the printing medium, wherein the first nip portion is disposed before the printing zone to deliver the printing medium to the printing zone, and a second rolling unit having a second nip portion to nip the printing medium, wherein the second nip portion is disposed downstream of the first rolling unit in a delivery direction of the printing medium. A distance between the first nip portion and the second nip portion is less than or equal to 3 inches.

5 Claims, 8 Drawing Sheets

INKJET IMAGE FORMING APPARATUS HAVING ARRAY TYPE PRINT HEAD

CROSS-REFERENCE TO RELATED APPLICATIONS

This application claims the benefit of Korean Patent Application No. 2008-0090358, filed on Sep. 12, 2008 in the Korean Intellectual Property Office, the disclosure of which is incorporated herein by reference in its entirety.

BACKGROUND OF THE INVENTION

1. Field of the Invention

The present general inventive concept relates to an inkjet image forming apparatus, and, more particularly, to an inkjet image forming apparatus having an array type print head.

2. Description of the Related Art

An image forming apparatus is an apparatus to print an image on a printing medium according to input image signals. Examples of the image forming apparatus include printers, copiers, facsimiles, and devices combining functions thereof.

Of various image forming apparatuses, an inkjet image forming apparatus is designed to print an image by ejecting fine droplets of ink onto desired positions on a printing medium. An inkjet image forming apparatus basically includes a print head having an ink discharge nozzle part, and a delivery device to deliver a printing medium.

The delivery device may adopt any one of various shapes of delivery members to deliver a printing medium. For example, the delivery device may deliver a printing medium by attaching the printing medium to a drum or belt, or by use of rollers arranged along a delivery path with a certain interval.

Using the rollers assures a simplified configuration and driving mechanism, and thus is advantageous to reduce the size of the inkjet image forming apparatus. However, such a roller delivery type setup may cause vibrations of a printing medium between rollers arranged downstream and upstream of a print head, thereby risking deterioration in print quality.

More specifically, if a printing medium vibrates in a printing zone where ink is discharged from a print head to a printing medium, a gap between the print head and the printing medium (head gap) varies, causing ink droplets to be ejected to unwanted positions on the printing medium, resulting in deterioration in print quality. In the worst case scenario, the print head may be brought into contact with, and contaminated by, a nozzle part of the print head.

Recently, there has been developed an inkjet image forming apparatus (hereinafter, referred to as an "array head type inkjet image forming apparatus") to enable high-speed printing using an array type print head wherein a nozzle part has a length corresponding to a width of a printing medium.

In the array head type inkjet image forming apparatus, a print head does not move during printing, and an image is printed on a printing medium as the printing medium passes through a printing zone below the print head. However, the array head type inkjet image forming apparatus may suffer from serious deterioration in print quality due to vibration of a printing medium between rollers.

SUMMARY OF THE INVENTION

The present general inventive concept provides an inkjet image forming apparatus having an array type print head to assure stable delivery of a printing medium in a printing zone.

Additional aspects and/or utilities of the present general inventive concept will be set forth in part in the description which follows and, in part, will be obvious from the description, or may be learned by practice of the present general inventive concept.

Embodiments of the present general inventive concept can be achieved by providing an inkjet image forming apparatus that includes: an array type print head including a nozzle part to discharge ink to a printing zone, t; a first rolling unit having a first nip portion to nip the printing medium, wherein the first nip portion is disposed before the printing zone to deliver the printing medium to the printing zone; and a second rolling unit having a second nip portion to nip the printing medium, wherein the second nip portion is disposed downstream of the first rolling unit in a delivery direction of the printing medium, wherein a distance between the first nip portion and the second nip portion is less than or equal to 3 inches.

The distance between the first nip portion and the second nip portion may be at least 1 inch.

A width of the nozzle part may be less than 1 inch.

The inkjet image forming apparatus may further include: a printing medium guide to guide the printing medium passing through the printing zone, wherein the first rolling unit and the second rolling unit may be disposed on the printing medium guide.

The inkjet image forming apparatus may further include: a platen disposed below the printing zone, to guide the printing medium.

The inkjet image forming apparatus may further include: a first printing medium guide disposed upstream of the platen in the delivery direction of the printing medium; and a second printing medium guide disposed downstream of the platen in the delivery direction of the printing medium, wherein the first rolling unit may be disposed on the first printing medium guide, and the second rolling unit may be disposed on the second printing medium guide.

The second rolling unit may include a star wheel to come into point contact with the printing medium.

The inkjet image forming apparatus may include a distance between the array type print head and the printing medium that varies by less than 0.3 mm.

Embodiments of the present general inventive concept can also be achieved by providing an inkjet image forming apparatus that includes: a printing medium delivery path including a printing zone; an array type print head to discharge ink, at a fixed position thereof, to a printing medium passing through the printing zone; a first roller disposed before the printing zone on a delivery path of the printing medium, wherein the first roller has a first nip portion to nip the printing medium; a second roller disposed after the printing zone on a delivery path of the printing medium, wherein the second roller has a second nip portion to nip the printing medium, wherein a distance between the first nip portion and the second nip portion is about 1 inch to about 3 inches.

The inkjet image forming apparatus may further include: a printing medium guide to guide the printing medium before and after the printing zone, wherein the first roller and the second roller are disposed on the printing medium guide.

The inkjet image forming apparatus may further include: a platen disposed in the printing zone; a first printing medium guide disposed upstream of the platen in the delivery direction of the printing medium; and a second printing medium guide disposed downstream of the platen in the delivery direction of the printing medium, wherein the first roller may be disposed on the first printing medium guide, and the second roller may be disposed on the second printing medium guide.

The inkjet image forming apparatus may further include: a star wheel disposed opposite the second roller.

Embodiments of the present general inventive concept can also be achieved by providing an inkjet image forming apparatus that includes: a printing medium delivery path including a printing zone; an array type print head including a nozzle part having a length, in a first direction, at least greater than a width of a printable printing medium; a platen having a first position disposed at the printing zone and a second position separate from the printing zone; a first printing medium guide disposed before the platen in a delivery direction of the printing medium when the platen is at the first position; a second printing medium guide disposed after the platen in a delivery direction of the printing medium when the platen is at the first position; a first rolling unit having a first roller disposed on the first printing medium guide and a first pinch roller to be engaged with the first roller so as to define a first nip portion; and a second rolling unit having a second roller disposed on the second printing medium guide and a second pinch roller to be engaged with the second roller so as to define a second nip portion, wherein a distance between the first nip portion and the second nip portion is less than or equal to 3 inches.

The nozzle part may have a length in a second direction of less than or equal to 1 inch.

BRIEF DESCRIPTION OF THE DRAWINGS

These and/or other aspects and utilities of the exemplary embodiments of the present general inventive concept will become apparent and more readily appreciated from the following description of the embodiments, taken in conjunction with the accompanying drawings, of which.

DETAILED DESCRIPTION OF THE PREFERRED EMBODIMENTS

Figure 1:
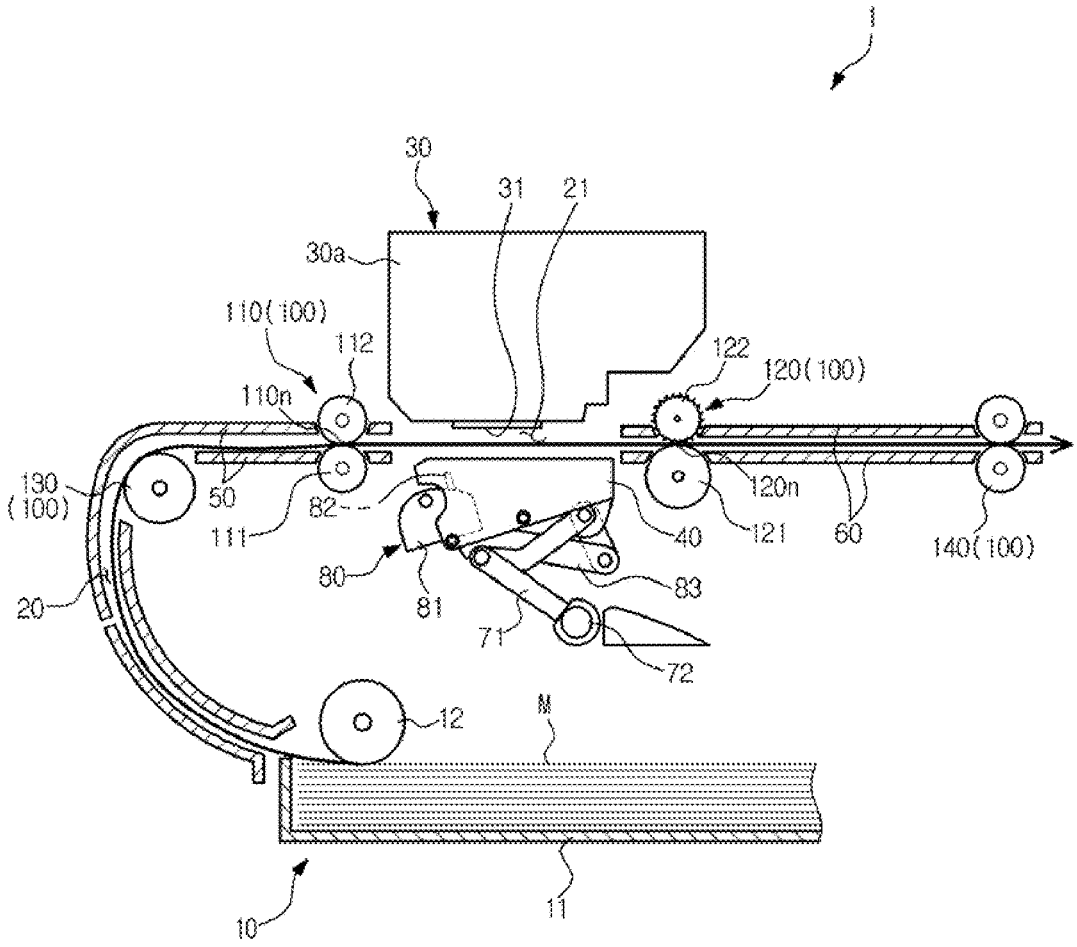
FIG. 1 is a view illustrating a configuration of an inkjet image forming apparatus in accordance with an embodiment of the present general inventive concept.

Reference will now be made in detail to an exemplary embodiment of the present general inventive concept, examples of which are illustrated in the accompanying drawings, wherein like reference numerals refer to like elements throughout. The embodiments are described below to explain the present general inventive concept by referring to the figures.

Figure 2:
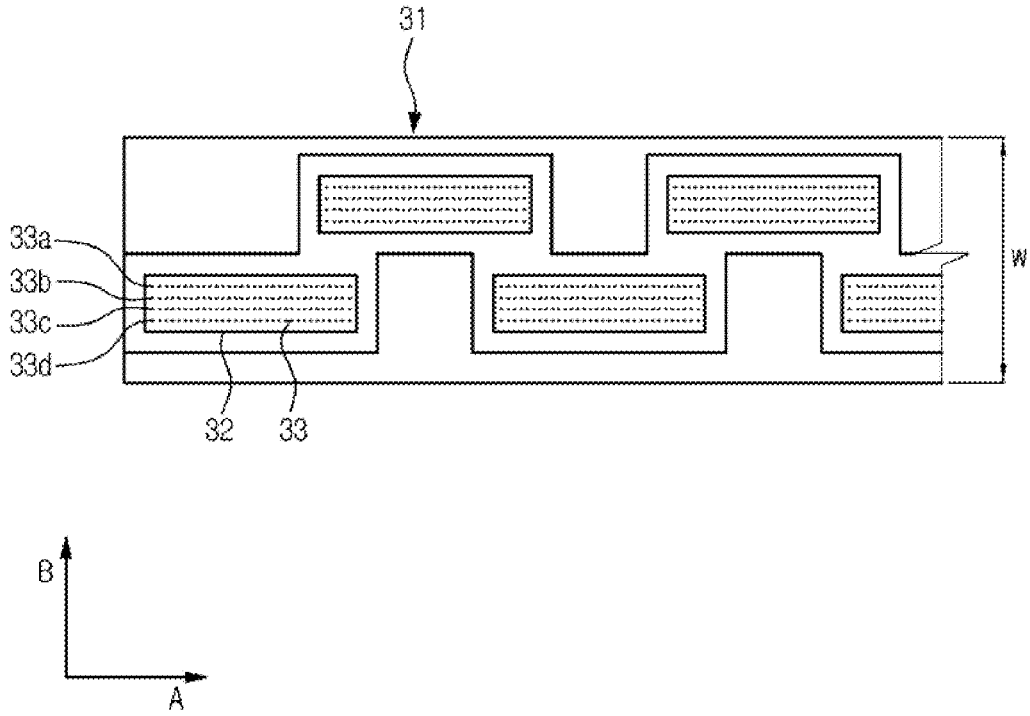
FIG. 2 is a view illustrating a nozzle part of a print head provided in the inkjet image forming apparatus of FIG. 1.

FIG. 1 is a view illustrating a configuration of an inkjet image forming apparatus in accordance with an embodiment of the present general inventive concept. FIG. 2 is a view illustrating a nozzle part of a print head provided in the inkjet image forming apparatus of FIG. 1.

As shown in FIG. 1, an inkjet image forming apparatus 1 includes a printing medium feed device 10, a delivery device 100, a printing medium delivery path 20, a print head 30, a platen 40, a first printing medium guide 50, and a second printing medium guide 60.

The printing medium feed device 10 stores a printing medium M and feeds the stored printing medium M to the printing medium delivery path 20. The printing medium feed device 10 includes a tray 11 in which the printing medium M is loaded, and a pickup roller 12 to pick up the printing medium M loaded in the tray 11 sheet by sheet.

The printing medium delivery path 20 is a path along which the printing medium M is delivered during a printing operation. The printing medium delivery path 20 includes a printing zone 21 where ink is discharged to the printing medium M being delivered.

The delivery device 100 serves to deliver the printing medium M along the printing medium delivery path 20. The delivery device 100 includes a first rolling unit 110 and a second rolling unit 120. The first rolling unit 110 is disposed immediately upstream of the printing zone 21 in a printing medium delivery direction and serves to deliver the printing medium M to the printing zone 21. The second rolling unit 120 is disposed immediately downstream of the first rolling unit 110 in the printing medium delivery direction and serves to deliver the printing medium M having passed through the printing zone 21. The first rolling unit 110 has a first nip portion **110*n* to nip the printing medium M being delivered, and to retain the printing medium M upstream and downstream of the printing zone 21. The second rolling unit 120 has a second nip portion 120*n* to nip the printing medium M being delivered, and to retain the printing medium M downstream of the printing zone 21**.

The first rolling unit 110 may include a first roller 111 and a first pinch roller 112 to be engaged with the first roller 111. The nip portion **110*n* of the first rolling unit 110 is defined as an engaging portion of the first roller 111 and first pinch roller 112**.

The second rolling unit 120 may include a second roller 121 and a star wheel 122 to be engaged with the second roller 121. The star wheel 122 comes into point contact with an upper surface of the printing medium M, to stably guide the printing medium M. The nip portion **120*n* of the second rolling unit 120 is defined as an engaged portion of the second roller 121 and star wheel 122**.

An auxiliary roller 130 may be disposed between the pickup roller 12 and the first rolling unit 110. A discharge roller 140 may be disposed downstream of the second rolling unit 120 in the printing medium delivery direction, to discharge the printing medium M out of the inkjet image forming apparatus 1.

As shown in FIGS. 1 and 2, the print head 30 has a nozzle part 31 in which nozzles to discharge ink to the printing zone 21 are arranged. In the present embodiment, the print head 30 is an array type print head wherein the nozzle part 31 has a length corresponding to a width of the printing medium M in a first direction (designated by the arrow A). The length of the nozzle part 31 may be at least greater than a width of a printable printing medium. Here, the array type print head may be constructed of a single print head having a length substantially corresponding to a width of a printing medium, or a plurality of print heads having a total arrangement length substantially corresponding to a width of a printing medium.

During a printing operation of the inkjet image forming apparatus 1, the array type print head 30 ejects ink, at a fixed position above the printing zone 21, to the printing medium M being delivered in a second direction (designated by the arrow B).

The nozzle part 31 includes a plurality of nozzle plates 32 arranged alternately in a zigzag pattern. Each nozzle plate 32 has a plurality of nozzles 33 to discharge ink, which are arranged in the first direction A. The nozzle plate 32 may contain a plurality of nozzle rows 33*a*, 33*b*, 33*c* and 33*d*. The respective nozzle rows 33*a*, 33*b*, 33*c* and 33*d* may eject the same color of ink, or different colors of inks (for example, cyan, magenta, yellow and black), respectively.

The nozzle part 31 may have various shapes different from that seen in the illustration of FIG. 2, and the scope of the present general inventive concept is not limited to the illustration of FIG. 2. For example, although FIG. 2 illustrates the nozzle part 31 of the print head 30 having a length corresponding to a width of a printing medium of a specific size (for example, A4 sheet), a plurality of discrete nozzle parts each having a length equal to about a half or one third a width of a printing medium may be provided.

Figure 3:
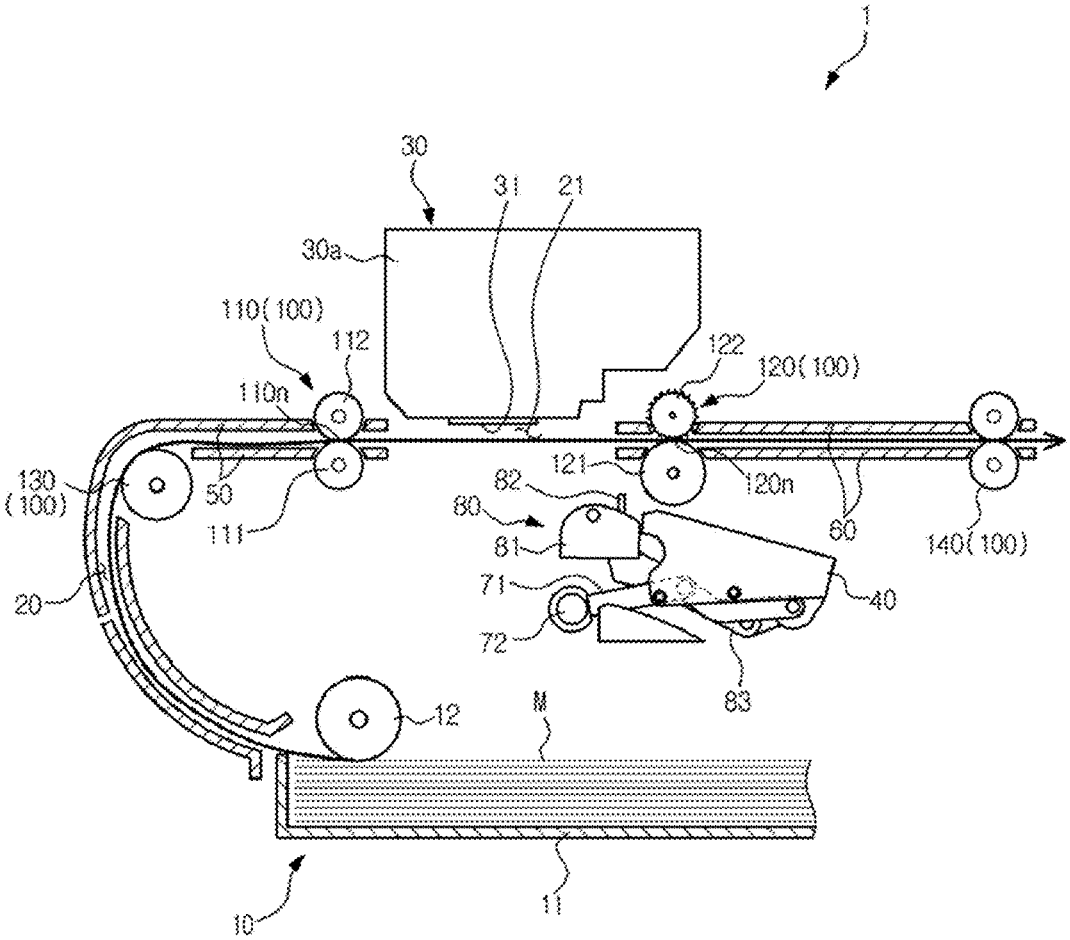
FIG. 3 is a view illustrating a platen provided in the inkjet image forming apparatus of FIG. 1, which is moved from a first position to a second position.

FIG. 3 is a view illustrating the platen provided in the inkjet image forming apparatus of FIG. 1, which is moved from a first position to a second position.

During a printing operation, as shown in FIG. 1, the platen 40 is located below the printing zone 21 and serves to guide the printing medium M being delivered. On the other hand, during a maintenance operation to keep the nozzle part 31 of the print head 30 in a normal state, the platen 40 is moved from a first position as shown in FIG. 1 to a second position as shown in FIG. 3, so as to open the bottom of the nozzle part 31.

As shown in FIGS. 1 and 3, the platen 40 is connected with a platen drive shaft 72 via a link 71 and in turn, the platen drive shaft 72 is connected with a maintenance motor (not shown). Accordingly, the platen drive shaft 72 is rotated by forward/reverse rotation of the maintenance motor (not shown), allowing the platen 40 connected with the platen drive shaft 72 via the link 71 to be moved between the first position and the second position.

The inkjet image forming apparatus 1 may include a wiping unit 80 for the maintenance operation of the print head 30. The wiping unit 80 includes a wiping body 81 provided with a wiper 82, which serves to wipe the nozzle part 31 below the print head 30. The wiping body 81 is connected with the platen 40 via a link 83, to move in accordance with movement of the platen 40.

Specifically, when the platen 40 is at a printing position (first position) as shown in FIG. 1, the wiping unit 80 is located below the platen 40. When the platen 40 is moved to the maintenance position (second position) as shown in FIG. 3, the wiping unit 80 is moved down along with the platen 40. In addition, as the platen 40 is returned from the maintenance position to the printing position, the wiping unit 80 wipes the nozzle part 81 of the print head 30, removing impurities or residual ink attached to the nozzle part 31. The wiping unit 80 then returns to a position below the platen 40, as the platen 40 returns to the printing position.

As shown in FIG. 1, with respect to the delivery direction of the printing medium M, the first printing medium guide 50 is disposed upstream of the platen 40 and the second printing medium guide 60 is disposed downstream of the platen 40. The first printing medium guide 50 guides the printing medium M being delivered to the printing zone 21, and the second printing medium guide 60 guides the printing medium M to be discharged to an area outside the inkjet image forming apparatus by way of the printing zone 21.

If a printing operation begins, as shown in FIG. 1, the pickup roller 12 picks up the printing medium M loaded in the tray 11. The picked-up printing medium M enters the printing zone 21 by way of the auxiliary roller 130 and first rolling unit 110. The array type print head 30 prints an image on the printing medium M by discharging ink to the printing medium M passing through the printing zone 21. The printing medium M having passed through the printing zone 21 is delivered to the second rolling unit 120 and then, is discharged to an area outside the inkjet image forming apparatus by way of the discharge roller 140.

Typically, the printing medium M vibrates between the two rolling units 110 and 120 while passing through the printing zone 21. If the vibration of the printing medium M is excessive, a distance between the nozzle part 31 of the print head 30 and the printing medium M, i.e. a head gap varies, causing deterioration in print quality. Accordingly, the present general inventive concept defines a distance between the two rolling units 110 and 120 to minimize vibration of the printing medium M passing through the printing zone 21.

Figure 4:
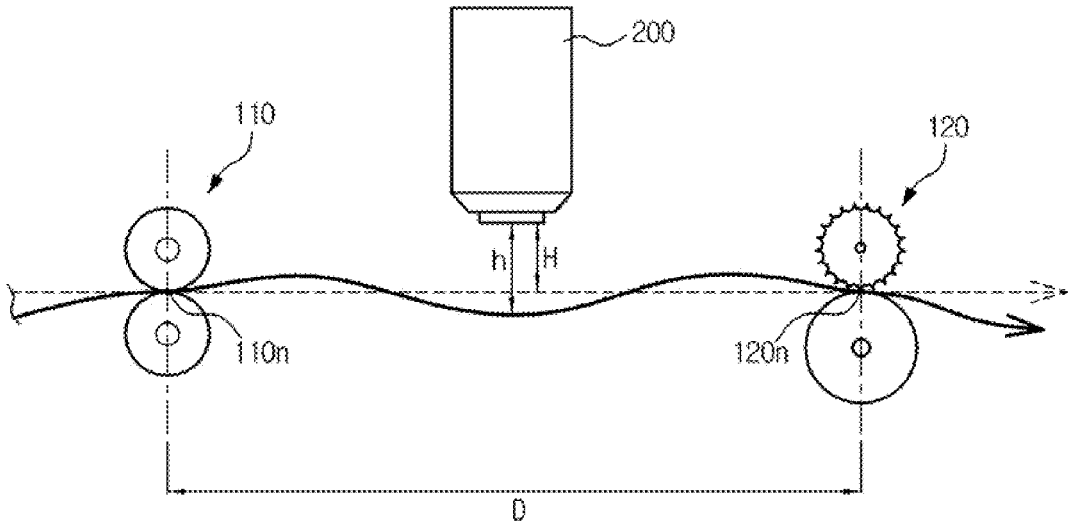
FIG. 4 is a view illustrating an experimental example to measure the vibration degree of a printing medium between a first rolling unit and a second rolling unit.

FIG. 4 is a view illustrating an experimental example to measure the vibration degree of the printing medium between the first rolling unit and the second rolling unit.

In an experiment of FIG. 4, the actual vibration degree of the printing medium M was measured using a displacement sensor 200 while varying a distance D between the nip portion 110*n* of the first rolling unit 110 and the nip portion 120*n* of the second rolling unit 120 (hereinafter, the distance D is defined as a distance between the two rolling units 110 and 120). The present experiment was performed, respectively, for the cases where the distance D is 1.5 inches, 2.0 inches, 3.0 inches, 3.5 inches and 4.9 inches. A general A4 sheet was used as the printing medium M.

The displacement sensor 200 is used to measure a distance h from the printing medium M, and is disposed above the printing medium M being delivered by the two rolling units 110 and 120. The displacement sensor 200 is also disposed such that a criterion distance H between the displacement sensor 200 and the printing medium M is 1 mm. Here, the criterion distance H between the displacement sensor 200 and the printing medium M is referred to as a distance between the printing medium M and the displacement sensor 200 measured in a state wherein the printing medium M does not vibrate.

The displacement sensor 200 is disposed midway between the two rolling units 110 and 120. For example, if the distance D is 1.5 inches, the displacement sensor 200 is disposed at a distance of 0.75 inches from each of the rolling units 110 and 120. If the distance D is 2.0 inches, the displacement sensor 200 is disposed at a distance of 1.0 inch from each of the rolling units 110 and 120.

If the print head 30 is installed to correspond to the displacement sensor 200, a variation in the distance h measured from the displacement sensor 200 means a variation in a distance between the print head 30 and the printing medium M, i.e. a variation in a head gap.

Figure 5:
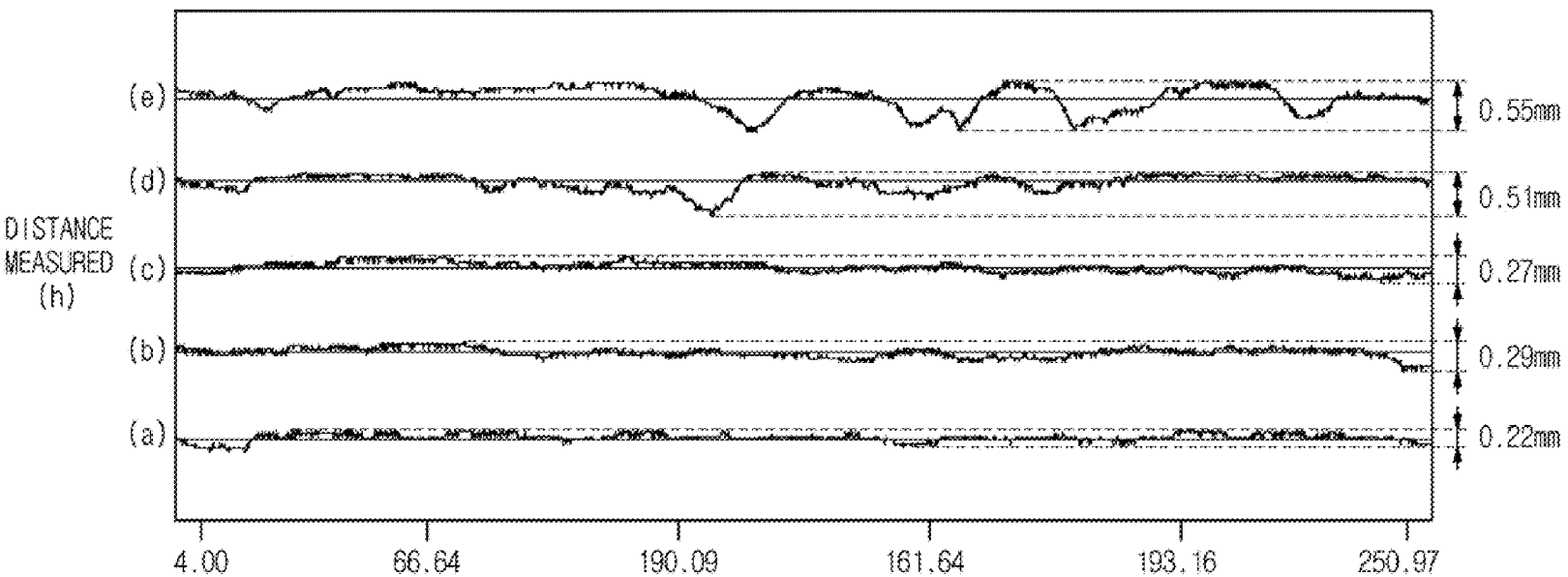
FIGS. 5 and 6 are graphs illustrating a sequential variation of a distance measured via an experiment of FIG. 4 with respect to a delivery direction of a printing medium.
Figure 6:
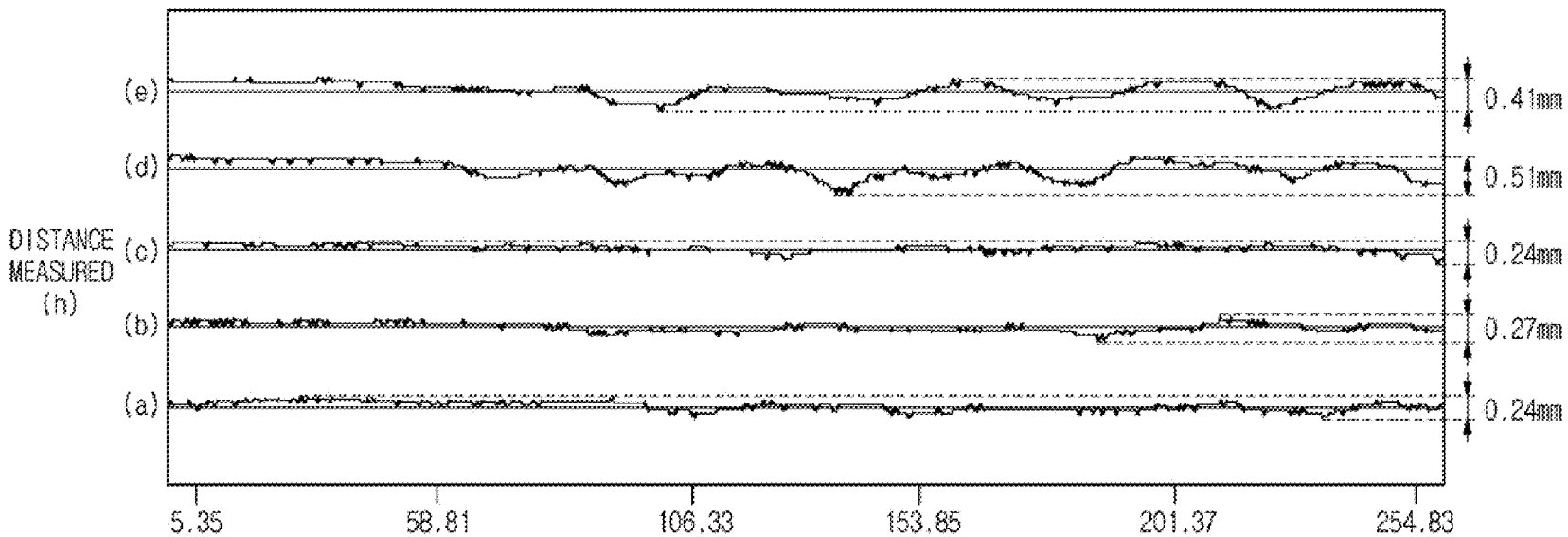

FIGS. 5 and 6 are graphs illustrating a sequential variation of the distance h measured via the experiment of FIG. 4 with respect to the delivery direction of the printing medium M. In FIGS. 5 and 6, a horizontal axis represents measuring positions on the basis of a tip end of the printing medium M in the delivery direction of the printing medium M. FIG. 5 illustrates results when a delivery speed of a printing medium is approximately 0.07 m/s, and FIG. 6 illustrates results when the delivery speed of the printing medium is approximately 0.34 m/s.

In FIGS. 5 and 6, five lines, i.e. lines (a), (b), (c), (d) and (e) are illustrated. The line (a) indicates the case where the distance D between the two rolling units 110 and 120 is 1.5 inches, the line (b) indicates the case where the distance D is 2.0 inches, the line (c) indicates the case where the distance D is 3.0 inches, the line (d) indicates the case where the distance D is 3.5 inches, and the line (e) indicates the case where the distance D is 4.9 inches.

Referring first to FIG. 5, it can be confirmed that the greater the distance D between the two rolling units 110 and 120, the greater the variation in the distance h measured from the displacement sensor 200 (as necessary, called "measured distance"). For example, when the distance D between the two rolling units 110 and 120 is 1.5 inches, the variation of the measured distance h is at most 0.22 mm. On the other hand, when the distance D between the two rolling units 110 and 120 is 4.9 inches, the variation of the measured distance h is at most 0.55 mm.

In particular, as can be confirmed by comparing the lines of FIG. 5, the measured distance h varies only slightly when the distance D between the two rolling units 110 and 120 is 1.5 inches, 2.0 inches and 3.0 inches, but has a steep variation when the distance D between the two rolling units 110 and 120 is 3.5 inches or more.

The above-described aspect is also shown in FIG. 6. Specifically, referring to FIG. 6, the variation in the measured distance h is 0.24 mm, 0.27 mm and 0.24 mm when the distance D between the two rolling units 110 and 120 is 1.5 inches, 2.0 inches and 3.0 inches, respectively, but rapidly increases to 0.51 mm and 0.41 mm when the distance D between the two rolling units 110 and 120 is 3.5 inches and 4.9 inches, respectively.

However, it can be appreciated by comparing FIGS. 5 and 6 that the distance measured from the displacement sensor 200 is not greatly affected by the delivery speed of the printing medium.

In the following Table 1, the variation in the measured distance h according to the distance D between the two rolling units 110 and 120 is represented by sigma level as a comparative numerical value. Sigma level in Table 1 is a value on the basis of a specification limit of ±0.1 mm from the criterion distance (H=1.0 mm).

In Table 1, in addition to the cases where the delivery speed of the printing medium is 0.07 m/s and 0.34 m/s, even the cases where the delivery speed of the printing medium is 0.15 m/s and 0.26 m/s, data as shown in FIGS. 5 and 6 were calculated and the results are represented as sigma level.

TABLE 1

| | | 1.5 inches | 2.0 inches | 3.0 inches | 3.5 inches | 4.9 inches |
|---|---|---|---|---|---|---|
| Sigma Level | 0.07 m/s | 3.43 | 3.09 | 3.01 | 2.11 | 1.56 |
| | 0.15 m/s | 3.10 | 3.32 | 3.32 | 2.03 | 1.58 |
| | 0.26 m/s | 3.02 | 3.16 | 3.03 | 2.17 | 1.60 |
| | 0.34 m/s | 3.05 | 3.06 | 3.36 | 1.94 | 2.08 |

Assuming that characteristic values of a target variable to be analyzed follow a normal distribution, sigma level indicates that a distance from an average of the characteristic values to a specification limit is how many times greater than a standard deviation.

As shown in Table 1, when representing the variation in the measured distance h as sigma level, a greater sigma level means a smaller variation in the measured distance h, resulting in stable delivery of a printing medium.

Referring to Table 1, it can be appreciated that the variation in the measured distance h is 3 sigma or more when the distance D between the two rolling units 110 and 120 is in a range of 1.5~3 inches, and represents similar values regardless of the distance D between the two rolling units 110 and 120. However, as can be confirmed, the variation in the measured distance h is in a range of 1.5~2.0 sigma when the distance D between the two rolling units 110 and 120 is 3.5 inches or more and has a large difference as compared to the distance D in a range of 1.5~3 inches.

Figure 7:
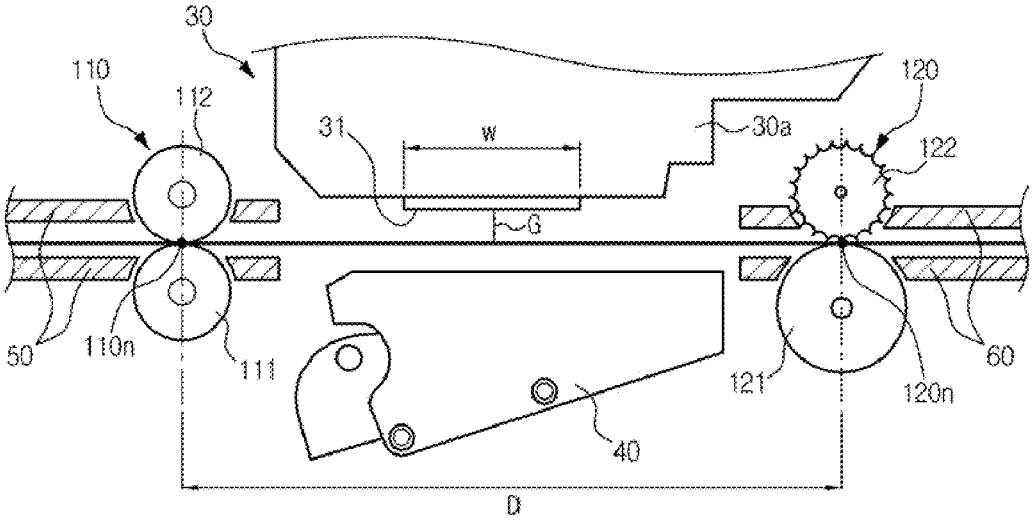
FIG. 7 is a partial view of FIG. 1.

FIG. 7 is a partial view of FIG. 1. After considering all the above experimental results, it can be appreciated that the head gap G in FIG. 7 has a stable level of variation when the distance D between the nip portions 110*n* and 120*n* of the two rolling units 110 and 120 is not more than 3.0 inches, but the level of variation rapidly increases when the distance D is 3.5 inches or more. Accordingly, in the present general inventive concept, the two rolling units 110 and 120 are arranged such that the distance between the nip portions 110 and 120*n* is not more than 3 inches.

As shown in FIG. 1, the first rolling unit 110 may be disposed on the first printing medium guide 50, and the second rolling unit 120 may be disposed on the second printing medium guide 60. Although one might consider disposing at least one of the rollers 111, 112, 121 and 122 of the first and second rolling units 110 and 120 on the body 30*a* of the print head 30 or on the platen 40 when the distance D between the two rolling units 110 and 120 is 3 inches or less, disposing at least one of the rollers on the body 30*a* of the print head 30 or on the platen 40 may complicate a configuration of the print head 30 or the platen 40, and may cause at least one of the rollers to be contaminated by ink droplets discharged from the print head 30. Therefore, it is an aspect of the present general inventive concept that the first rolling unit 110 and second rolling unit 120 be disposed on the first printing medium guide 50 and second printing medium guide 60, respectively.

When the distance D between the two rolling units 110 and 120 is not more than 3 inches, it is preferable that a width W of the nozzle part 31 of the print head 30 (i.e. a length of the nozzle part 31 in the second direction) be not more than 1 inch.

Figure 8:
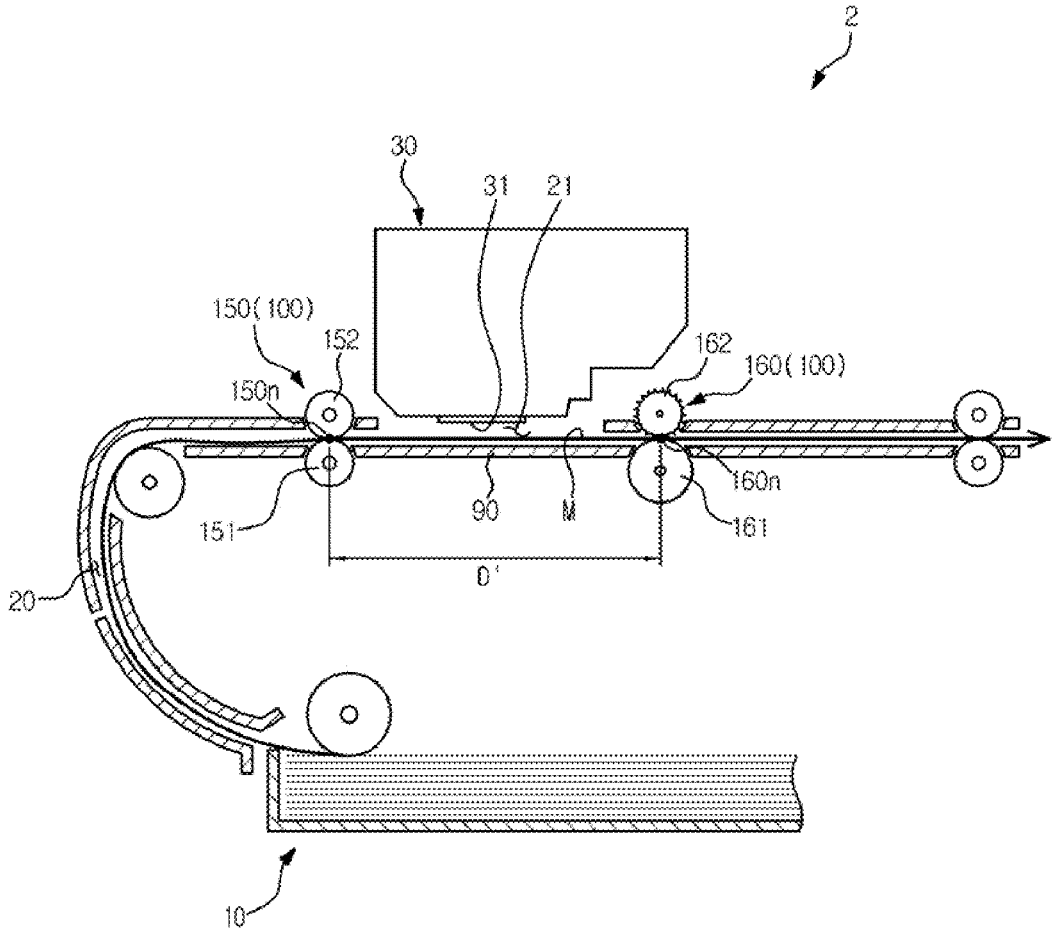
FIG. 8 is a view illustrating a configuration of an inkjet image forming apparatus in accordance with another embodiment of the present general inventive concept.

FIG. 8 is a view illustrating a configuration of an inkjet image forming apparatus in accordance with another embodiment of the present general inventive concept.

As shown in FIG. 8, an inkjet image forming apparatus 2 may include the printing medium feed device 10, the delivery device 100, the printing medium delivery path 20, the print head 30, and a printing medium guide 90.

The print head 30 has the nozzle part 31 in which the nozzles to discharge ink to the printing zone 21 are arranged. In the present embodiment, the print head 30 is an array type print head described with relation to FIG. 2.

The print head 30 is disposed above the printing medium delivery path 20, and the printing medium delivery path 20 includes the printing zone 21 where ink is discharged to the printing medium.

The printing medium guide 90 serves to guide a printing medium being delivered along the printing medium delivery path 20. At a region thereof corresponding to the printing zone 21, the top of the printing medium guide 90 is opened and the bottom of the printing medium guide 90 extends along the printing medium delivery path 20 to guide the printing medium M. That is, in the present embodiment, the platen as shown in FIG. 1 is not installed below the printing zone 21.

The delivery device 100 includes a first rolling unit 150 and a second rolling unit 160, which are disposed on the printing medium guide 90. The printing zone 21 is located between the first rolling unit 150 and the second rolling unit 160. The first rolling unit 150 may include a first roller 151 and a first pinch roller 152 to be engaged with the first roller 151. The second rolling unit 160 may include a second roller 161 and a star wheel 162 to be engaged with the second roller 161.

The first and second rolling units 150 and 160 have nip portions 150*n* and 160*n* to nip the printing medium M, respectively, and are disposed such that a distance D' between the nip portions 150*n* and 160*n* is not more than 3 inch.

Although the above-described exemplary embodiments describe an example wherein the first rolling unit 110 includes the first roller 111 and first pinch roller 112 and the second rolling unit 120 includes the second roller 121 and star wheel 122, the scope of the present general inventive concept is not limited to these examples. For example, any one of the first roller 111 and first pinch roller 112 may be omitted from the first rolling unit 110. In this case, the remaining single roller may define a nip portion in cooperation with the first printing medium guide 50. Similarly, any one of the second roller 121 and star wheel 122 may be omitted from the second rolling unit 120. The star wheel 122 of the second rolling unit 120 may be replaced by a pinch roller to be engaged with the second roller 121.

As apparent from the above description, the present general inventive concept can prevent deterioration in print quality due to vibration of a printing medium passing through a printing zone.

Although embodiments of the present general inventive concept have been shown and described, it would be appreciated by those skilled in the art that changes may be made in this embodiment without departing from the principles and spirit of the general inventive concept, the scope of which is defined in the claims and their equivalents.

What is claimed is:

1. An inkjet image forming apparatus comprising:

a printing medium delivery path including a printing zone;

an array type print head including a nozzle part having a length, in a first direction, at least greater than a width of a printable printing medium;

a platen having a first position disposed at the printing zone and a second position separate from the printing zone;

a first printing medium guide disposed before the platen in a delivery direction of the printing medium when the platen is at the first position;

a second printing medium guide disposed after the platen in a delivery direction of the printing medium when the platen is at the first position;

a first rolling unit having a first roller disposed on the first printing medium guide and a first pinch roller to be engaged with the first roller so as to define a first nip portion; and a second rolling unit having a second roller disposed on the second printing medium guide and a second pinch roller to be engaged with the second roller so as to define a second nip portion, wherein a distance between the first nip portion and the second nip portion is less than or equal to 3 inches.

2. The apparatus according to claim 1, wherein the nozzle part has a length in a second direction of less than or equal to 1 inch.

3. The apparatus according to claim 1, wherein the distance is at least 1 inch.

4. The apparatus according to claim 1, wherein the second pinch roller includes a star wheel to come into point contact with the printing medium.

5. The apparatus according to claim 1, wherein a distance between the array type print head and the print medium varies by less than 0.3 mm.

* * * * *